US006708430B2

(12) United States Patent
Azure et al.

(10) Patent No.: US 6,708,430 B2
(45) Date of Patent: Mar. 23, 2004

(54) TRENCHER CHAIN BAR AND SAFETY GUIDE

(75) Inventors: John P. Azure, Bloomington, MN (US); Joseph C. Knipp, Elko, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 10/027,326

(22) Filed: Dec. 20, 2001

(65) Prior Publication Data

US 2003/0115780 A1 Jun. 26, 2003

(51) Int. Cl.[7] ..... E02F 9/20
(52) U.S. Cl. ..... 37/361; 37/462
(58) Field of Search ..... 37/352, 364, 465, 37/462, 361; 172/42

(56) References Cited

U.S. PATENT DOCUMENTS 5,033,214 A * 7/1991 Kaczmarski et al. ..... 37/350
6,249,993 B1 * 6/2001 Armstrong et al. ..... 37/361
6,349,488 B1 * 2/2002 Mason ..... 37/94
2002/0116844 A1 * 8/2002 Collins et al. ..... 37/364

OTHER PUBLICATIONS

Parts Catalog for Toro Trencher, 1999.

* cited by examiner

*Primary Examiner*—Robert E. Pezzuto
*Assistant Examiner*—Meredith Petravick
(74) *Attorney, Agent, or Firm*—James W. Miller

(57) ABSTRACT

A trencher includes a trencher frame mounting a chain bar in a cantilever manner with a safety guide overlying the chain bar. Both the chain bar and the safety guide are adjustable on the trencher frame between various laterally spaced positions with the safety guide being able to overlie the chain bar in the different laterally spaced positions. The chain bar comprises a mounting stub over which one end of an elongated boom may be inserted. The stub includes a central longitudinal slot for receiving bolts passing through the boom to secure the boom to the slot. The use of a longitudinal slot in the stub allows the height of the stub to be maximized relative to the height of the boom to provide a stronger and more durable mounting for the boom.

3 Claims, 5 Drawing Sheets

TRENCHER CHAIN BAR AND SAFETY GUIDE

TECHNICAL FIELD

This invention relates to a trencher having a roller chain carried on a chain bar. More particularly, this invention relates to the structure of the chain bar and to a safety guide that is adjustable in concert with the chain bar.

BACKGROUND OF THE INVENTION

Trenchers are known having an elongated chain bar that extends outwardly from the trencher frame in a cantilever manner. Such trenchers include a roller chain that is configured to cut, dig or otherwise remove material such as dirt or soil to create an elongated trench in the ground. The roller chain loops around the chain bar. The trencher frame carries a motor for powering the roller chain so that digging or cutting teeth provided on the roller chain will cut or dig soil as the roller chain is driven around and around the chain bar.

In prior art trenchers, the chain bar is typically formed of two major pieces that are secured together. The first piece comprises a stub fixed to the trencher frame. The second piece is an elongated boom having a socket at one end telescopically inserted over the stub. The boom is clamped to the stub by various bolts which pass through the boom and over the top and bottom surfaces of the stub.

Because the bolts used to clamp the boom to the stub press against the top and bottom surfaces of the stub, the height of the stub is quite small to accommodate the thickness of the bolts. Thus, for a given sized boom and drive sprocket carried on the boom, the attachment between the stub and the boom is not as robust or durable as might be desired due to the small size of the stub. Thus, a better way of attaching the boom to the stub is desirable in the art.

In addition, prior art trenchers have typically been built such that the chain bar is located in a first or normal position on one side of the frame. A safety guide or bar has been provided above this first position of the chain bar. In some prior art trenchers, the chain bar can be moved to a second or offset position on the other side of the frame. However, the safety guide does not move with the chain bar as it is typically installed only above the first position of the chain bar and cannot be installed in any other position. Thus, when the chain bar is moved to its second or offset position, it is used in this position without the safety guide being located above it, which is disadvantageous.

SUMMARY OF THE INVENTION

One aspect of this invention relates to a trencher for digging trenches. The trencher comprises a trencher frame. A chain bar is secured at one end to the trencher frame to extend outwardly from the trencher frame in a cantilever manner. An endless chain having digging teeth is provided with the endless chain being carried on the chain bar. The chain bar comprises a base member secured to the trencher frame which base member carries a stub having a longitudinal axis, an elongated boom having a socket at one end which socket is slipped over the stub of the base member, a slot in the stub with the slot extending parallel to the longitudinal axis of the stub, and at least one bolt passing through the boom and the slot to secure the boom to the stub.

Another aspect of this invention relates to a trencher for digging trenches. The trencher comprises a trencher frame. A chain bar is secured at one end to the trencher frame to extend outwardly from the trencher frame in a cantilever manner. An endless chain having digging teeth is provided with the endless chain being carried on the chain bar. A safety guide is secured at one end to the trencher frame to extend outwardly from the trencher frame in a cantilever manner. Both the chain bar and the safety guide are adjustable on the trencher frame between two laterally spaced positions with the safety guide overlying the chain bar in both of the two laterally spaced positions.

BRIEF DESCRIPTION OF THE DRAWINGS

This invention will be described hereafter in the Detailed Description, taken in conjunction with the following drawings, in which like reference numerals refer to like elements or parts throughout.

DETAILED DESCRIPTION

Figure 1:
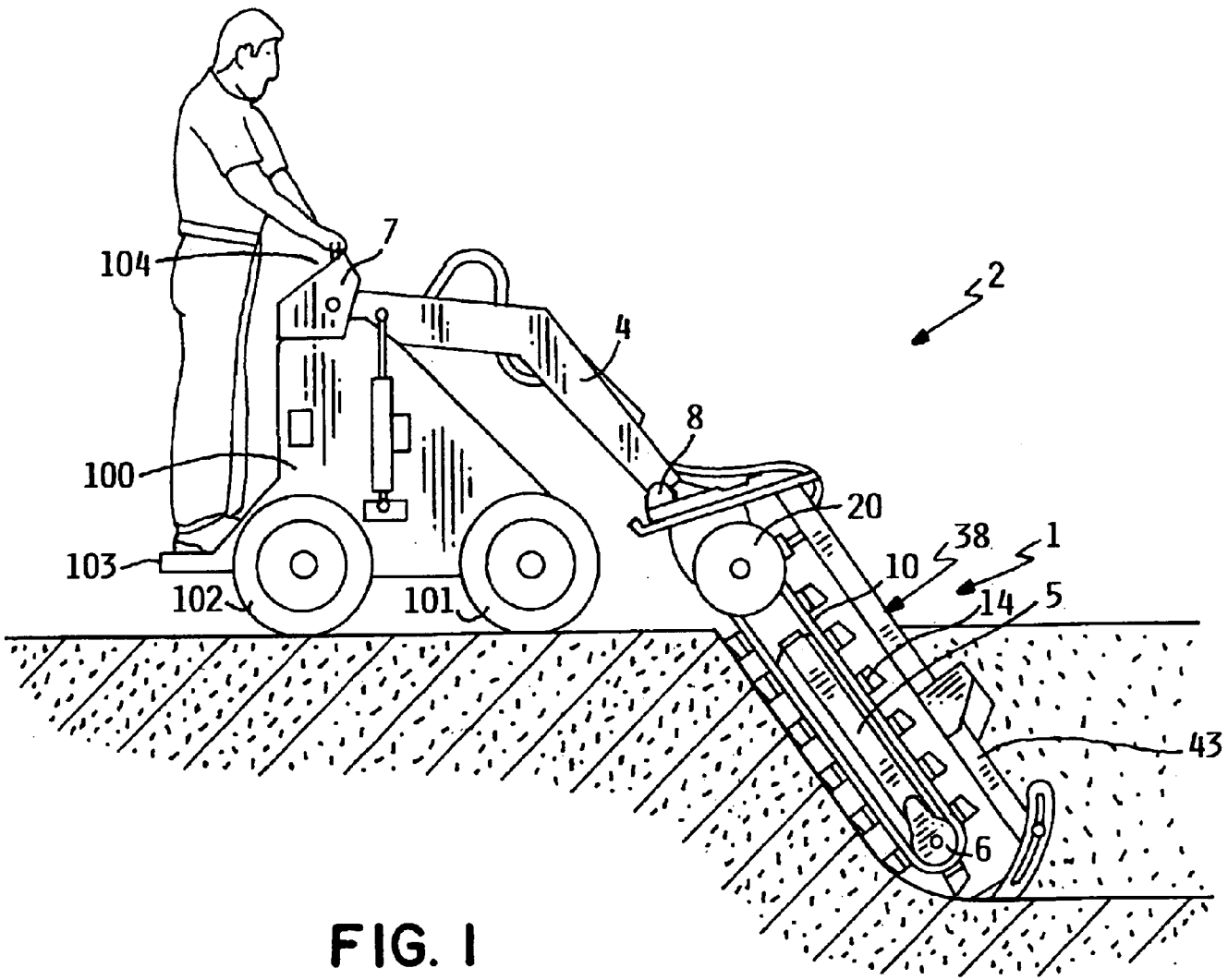
FIG. 1 is a side elevational view of a trencher which utilizes a roller chain to dig a trench with such roller chain being carried on a chain bar in an endless fashion, the trencher being shown in FIG. 1 in operation in the act of digging a trench.

FIG. 1 shows a trencher 2 in operation. Trencher 2 is carried on a set of lift arms 4, only one lift arm 4 being shown in FIG. 1 with the other lift arm 4 being hidden in FIG. 1. Lift arms 4 form part of a compact utility loader 100. Compact utility loader 100 is capable of releasably coupling various attachments, such as trencher 2, to the lower ends of lift arms 4 utilizing known quick attachment systems. When a trencher 2 is attached to lift arms 4 of compact utility loader 100, the overall combination is referred to as a trencher 2. Obviously, trencher 2 could also be a dedicated, single purpose machine in which trencher 2 is normally non-removably attached to a loader or other self-propelled frame.

Compact utility loader 100 as shown herein is comprised of a frame supported by front wheels 101 and rear wheels 102. An engine or motor (not shown) is carried on the loader frame to provide power. Compact utility loader 100 may also include a platform 103 on which the operator stands to operate loader 100, Alternatively, platform 103 could be removed and the operator could simply walk behind loader 100. The operation of lift arms 4 and the wheels 101 and 102 are controlled by operator controls 104. Loader 100 may be the type such as those manufactured and sold by The Toro Company, the assignee of this invention, as the DINGO brand compact utility loader.

As shown in FIG. 1, trencher 2 comprises a chain bar 5 that guides an endless roller chain 10. Roller chain 10 digs a trench by removing dirt and similar material from the ground as chain 10 is driven. Chain 10 includes a plurality of digging teeth 14 which are carried on chain 10 at spaced locations. Trencher 2 can be positioned against or in the ground by pivoting lift arms 4 about a first pivot point 7 on loader 100 and also by pivoting trencher 2 about a second pivot point 8 on the lower ends of lift arms 4.

Chain bar 5 includes a drive sprocket 3 at one end of bar 5 and an idler member 6 located at the opposite end of bar 5. Drive sprocket 3 is connected to and driven by a suitable drive system, such as a hydraulic motor 12, that is powered by the engine of loader 100. The drive system rotates drive sprocket 3, which in turn engages and drives chain 10 in an endless path around drive sprocket 3 and idler member 6.

Figure 2:
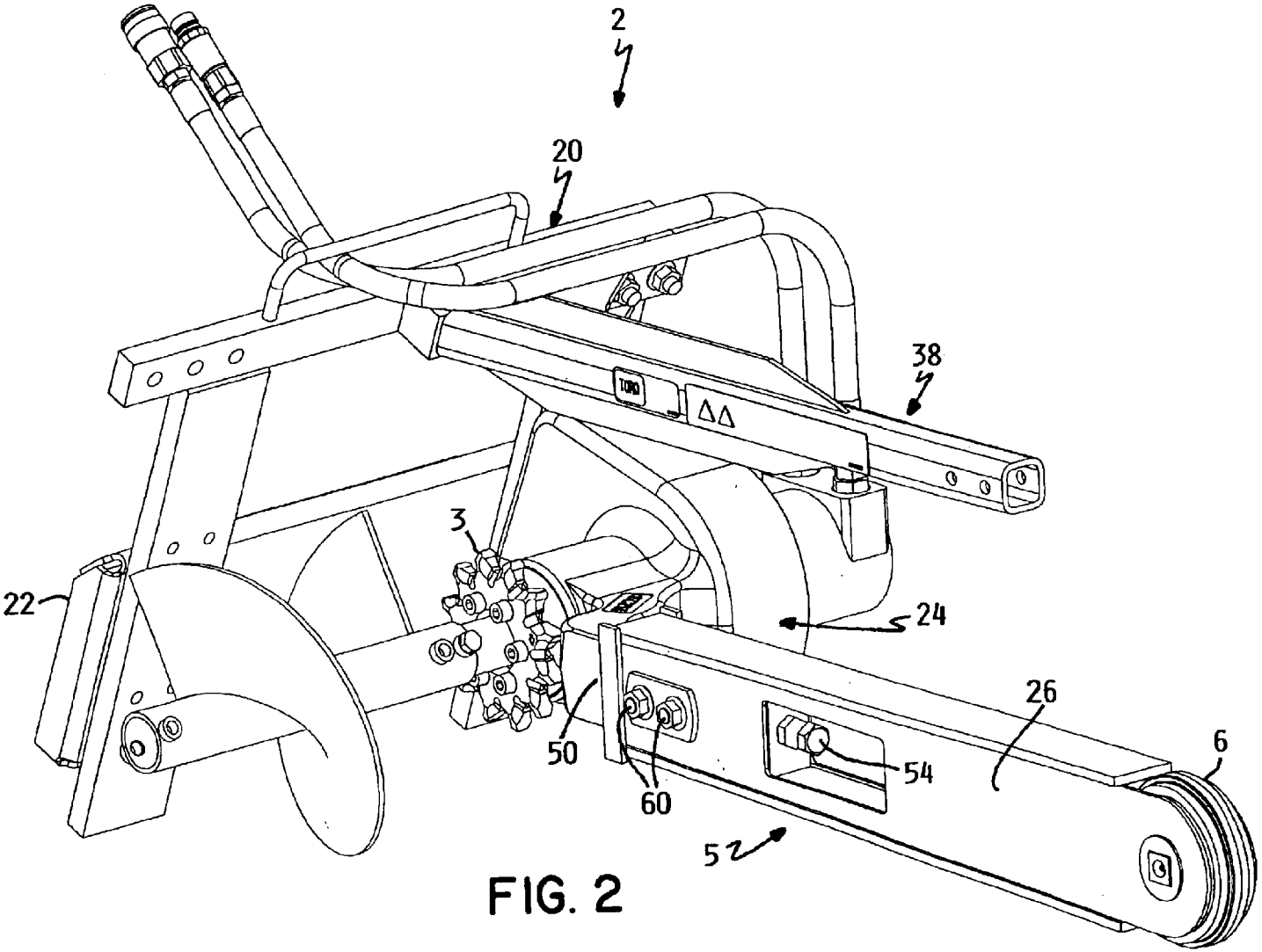
FIG. 2 is perspective view of a trencher according to this invention, particularly showing the chain bar and the safety guide in a first position on one side of the trencher frame, with the chain being omitted from FIG. 2 for clarity.
Figure 3:
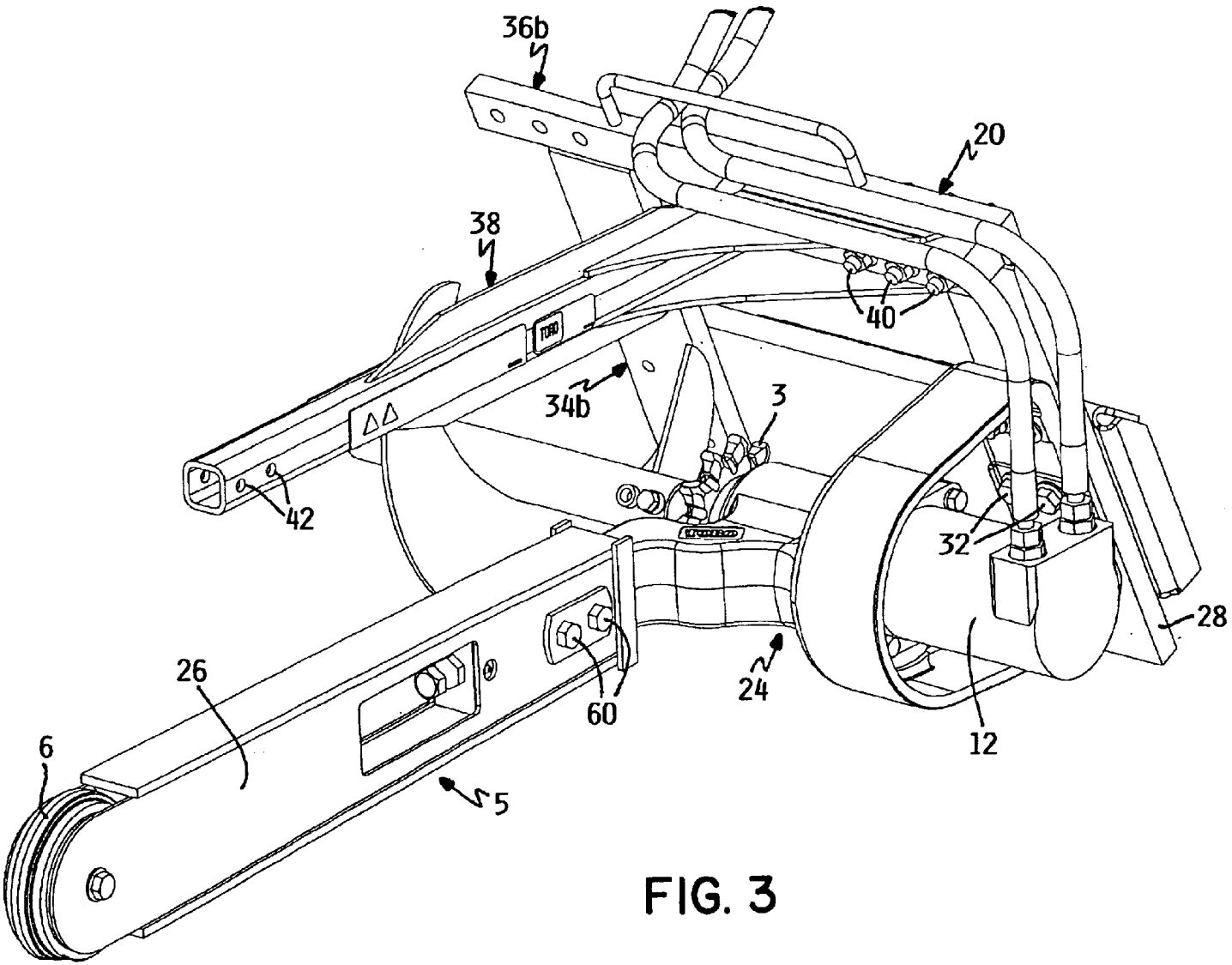
FIG. 3 is perspective view of the trencher shown in FIG. 2, but illustrating the trencher from the side which is opposite to the side that is shown in FIG. 2, with the chain being omitted from FIG. 3 for clarity.
Figure 4:
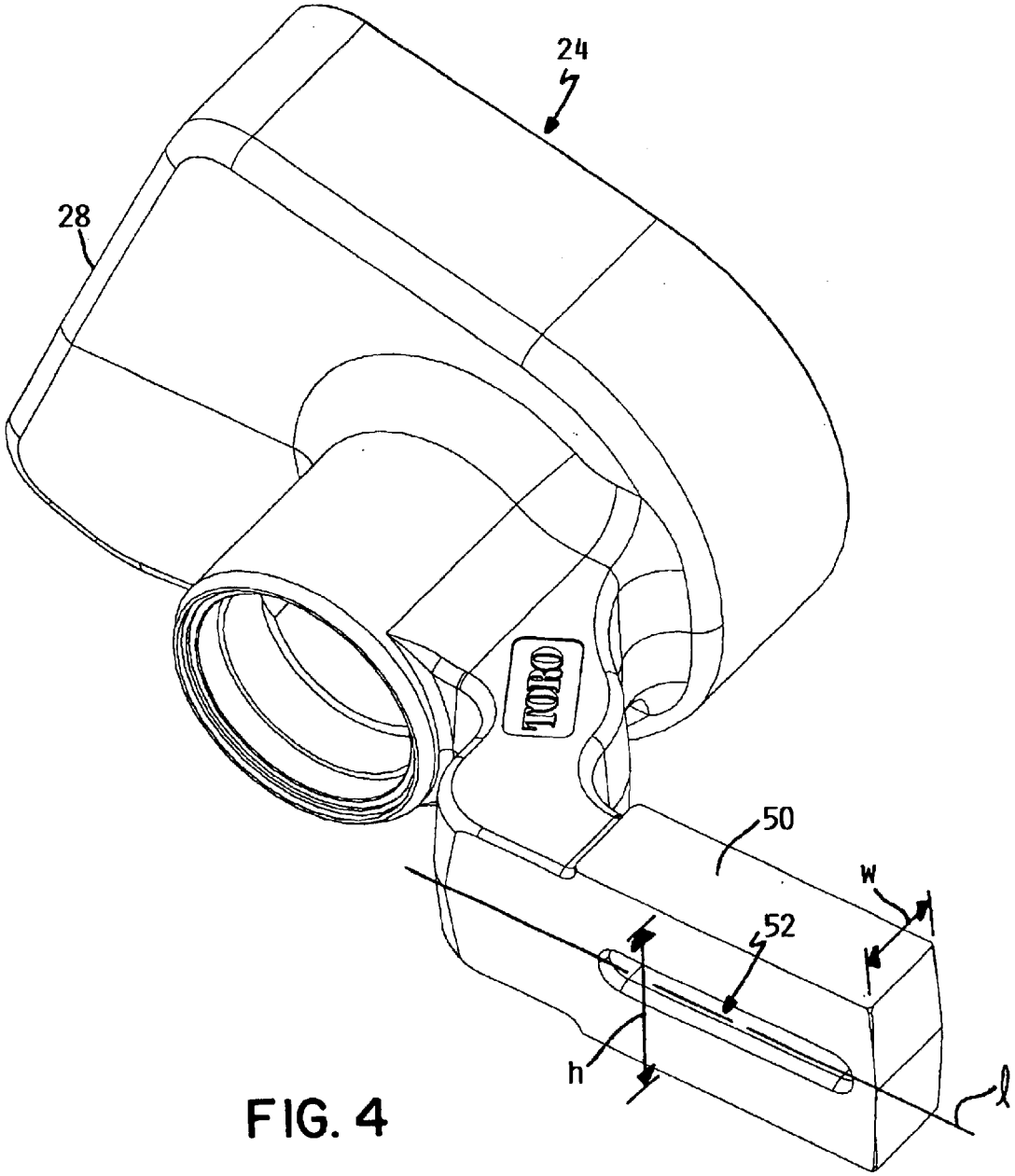
FIG. 4 is a perspective view of the base member and stub that forms part of the chain bar of the trencher shown in FIG. 2.

Referring now to FIGS. 2–4, trencher 2 includes a frame 20 from which chain bar 5 extends in a cantilever manner. When trencher 2 is built as an attachment for a loader 100, frame 20 also includes a quick attachment mount 22 that allows trencher 2 to be quickly and easily attached to loader arms 4. The shape and structure of frame 20 can obviously vary as well as the type of quick attachment mount 22 used to couple trencher 2 to loader 100. In addition, quick attachment mount 22 could be deleted when trencher 2 is part of a dedicated, single purpose machine.

Chain bar 5 comprises a base member 24 to which an outwardly extending boom 26 is secured in a cantilever manner. Base member 24 preferably comprises a single casting as shown in FIG. 4. Base member 24 includes a flange or rear wall 28 having a plurality of holes 30 extending therethrough. See FIG. 5. A plurality of bolts 32 or similar securing members can be used to pass through holes 30 to bolt base member 24 to trencher frame 20. FIG. 3 illustrates bolts 32 passing through holes 30 in rear wall 28 of base member 24 to bolt base member 24 to trencher frame 20.

Figure 5:
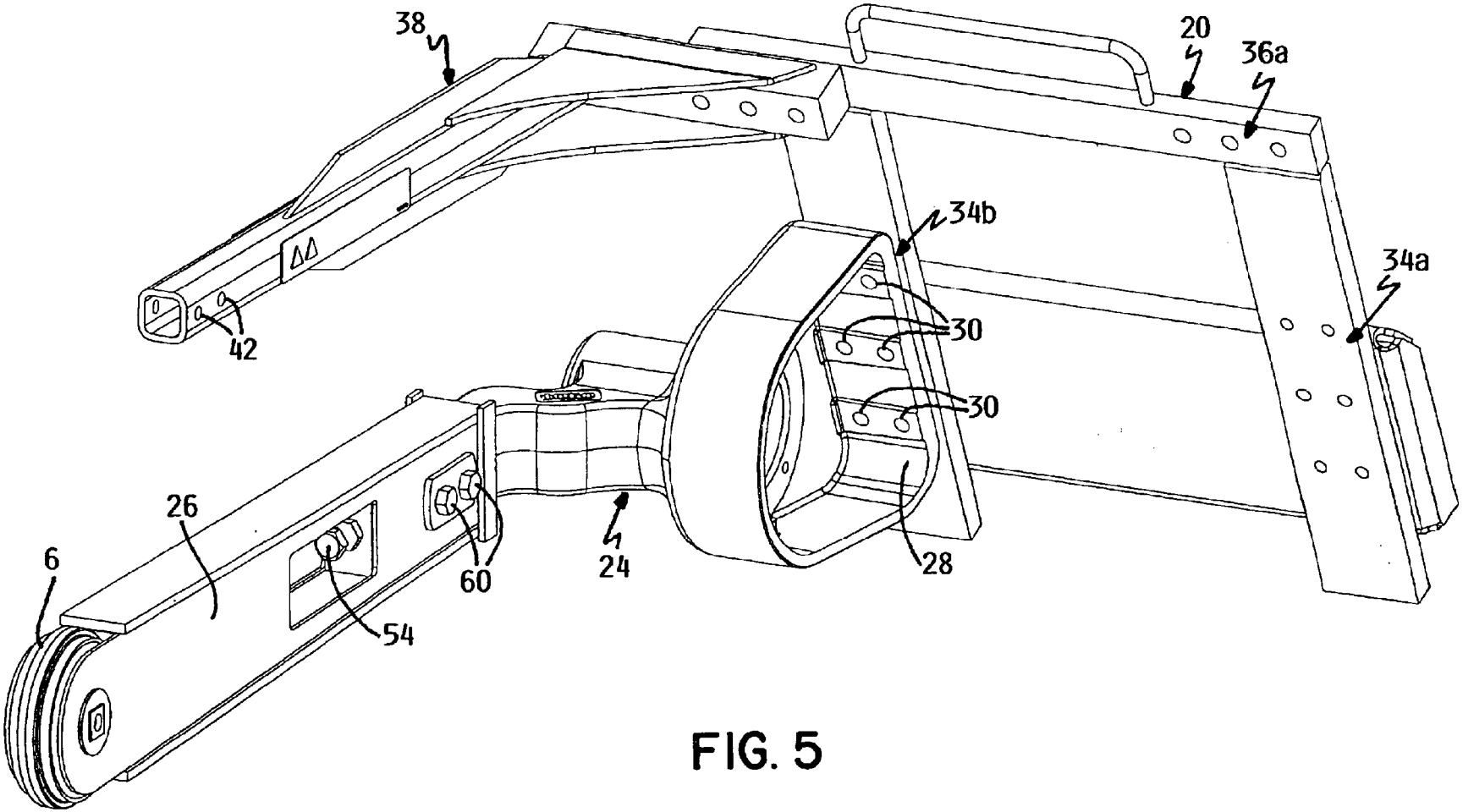
FIG. 5 is perspective view of a trencher according to this invention, particularly showing the chain bar and the safety guide in a second, offset position on the opposite side of the trencher frame from that which is depicted in FIG. 1, with the chain, drive sprocket and drive motor being omitted from FIG. 5 for clarity.

Trencher frame 20 includes first and second sets 34*a* and 34*b* of mounting holes which have a hole pattern that is the same as the pattern of holes 30 in rear wall 28 of base member 24. These sets 34*a* and 34*b* of mounting holes are transversely or laterally spaced apart on trencher frame 20 so that one set 34*a* of mounting holes is adjacent one side of trencher frame 20 and the other set 34*b* of mounting holes is adjacent the other side of trencher frame 20. FIGS. 2 and 3 illustrate chain bar 5 mounted on trencher frame 20 in a first position on one side of trencher frame 20 using a first set 34*a* of the mounting holes. FIG. 5 illustrates chain bar 5 mounted on trencher frame 20 in a second, laterally offset position using the second set 34*b* of mounting holes, with the attachment bolts 32 having been deleted from FIG. 5 to better illustrate holes 30 in rear wall 28 of base member 24.

Similarly, trencher frame 20 comprises first and second sets 36*a* and 36*b* of mounting holes for a safety guide 38. The dual sets 36*a* and 36*b* of safety guide mounting holes overlie the dual sets 34*a* and 34*b* of base member mounting holes to allow safety guide 38 to be installed above chain bar 5 regardless of what side of trencher frame 20 chain bar 5 is mounted on. Thus, as shown in FIGS. 2 and 3, when chain bar 5 is mounted on one side of trencher frame 20, safety guide 38 can be mounted above chain bar 5 using the first set 36*a* of safety guide mounting holes and a plurality of bolts 40 for bolting safety guide 38 to trencher frame 20. When chain bar 5 is laterally offset on trencher frame 20 and is mounted on the other side of trencher frame 20, safety guide 38 can similarly be moved over and be bolted to trencher frame 20 using the second set 36*b* of safety guide mounting holes. See FIG. 5. Thus, safety guide 38 can remain in place above chain bar 5 regardless of which side of trencher frame 20 carries chain bar 5.

The entire safety guide 38 is shown in FIGS. 2, 3 and 5. The front of safety guide 38 carries mounting holes 42 to which an optional crumber attachment 43 can be bolted if so desired. FIG. 1 shows the safety guide 38 with crumber attachment 43 secured thereto while FIGS. 2, 3 and 5 illustrate safety guide 38 without a crumber attachment 43. Note that safety guide 38 and crumber attachment 43 per se are well known in the art and their structure need not be specifically described herein. This invention does not relate to safety guide 38 per se such that the structure of safety guide 38 could be varied. Only one aspect of this invention relates to the dual sets 36*a* and 36*b* of safety guide mounting holes to allow safety guide 38 to be mounted on opposite sides of trencher frame 20 to be laterally adjustable in concert with the lateral adjustment of chain bar 5.

Returning now to FIG. 4, another portion of base member 24 comprises a forwardly extending mounting peg or stub 50. Mounting stub 50 has a rectangular cross-section. An elongated mounting slot 52 passes through stub 50 along a longitudinal axis of stub 50 indicated as 1 in FIG. 4. This longitudinal axis 1 is parallel to the intended direction of elongated chain bar 5. Slot 52 also passes completely through the width of stub 50, which width is indicated as w in FIG. 4, such that slot 52 is accessible from both sides of stub 50.

Elongated boom 26 of chain bar 5 is mounted to stub 50 by forming boom 26 with a socket at one end to allow the socket to be telescopically inserted over stub 50. After this has been done, chain 10 can be installed around drive sprocket 3 and idler member 6 and a longitudinal adjustment screw 54 can be tightened to take up the slack in chain 10. Boom 26 can then be secured to stub 50 by a plurality of bolts 60 which can be inserted through the sides of boom 26 such that bolts 60 pass through central slot 52 in stub 50. When nuts 58 are tightened on the opposite ends of bolts 60, boom 26 will then be secured in place to stub 50 of base member 24 of secure chain bar 5 to trencher frame 20.

Using a central mounting slot 52 in stub 50 allows the height of stub 50, indicated as h in FIG. 4, to be maximized for a given height of boom 26 or for a given diameter of drive sprocket 3. This is an improvement over the prior art in which the stub height was relatively small to allow bolts 60 to pass over the top and bottom surfaces of stub 50. Accordingly, chain bar 5 disclosed herein is stronger and more durable given the greater height of stub 50 to which boom 26 is attached.

Various modifications of this invention will be apparent to those skilled in the art. For example, while two laterally offset positions have been shown for both chain bar 5 and safety guide 38, more than two laterally offset positions could be used for each. Boom 26 is made from a plurality of side plates secured to top and bottom plates, but boom 26 could be integrally cast if so desired. Thus, the scope of this invention is to be limited only by the appended claims.

We claim:

1. A trencher for digging trenches, which comprises:

(a) a trencher frame;

(b) a chain bar secured at one end to the trencher frame to extend outwardly from the trencher frame in a cantilever manner;

(c) an endless chain having digging teeth with the endless chain being carried on the chain bar;

(d) a safety guide secured at one end to the trencher frame to extend outwardly from the trencher frame in a cantilever manner; and (e) wherein both the chain bar and the safety guide are adjustable on the trencher frame independently of one another between two laterally spaced positions with the safety guide overlying the chain bar in both of the two laterally spaced positions of the chain bar if desired by an operator but with the safety guide also remaining in one of the laterally spaced positions and becoming laterally offset relative to the chain bar if the chain bar is adjusted into the other laterally spaced position and the safety guide is not similarly adjusted by the operator.

2. The trencher of claim 1, wherein the chain bar and the safety guide are bolted to the trencher frame in each of the two laterally spaced positions.

3. A trencher for digging trenches, which comprises:

(a) a trencher frame;

(b) a chain bar secured at one end to the trencher frame to extend outwardly from the trencher frame in a cantilever manner;

(c) an endless chain having digging teeth with the endless chain being carried on the chain bar;

(d) a safety guide secured at one end to the trencher frame to extend outwardly from the trencher frame in a cantilever manner; and (e) wherein the trencher frame carries first and second sets of laterally spaced mounting holes for the chain bar to allow the chain bar to be mounted on the trencher frame in first and second laterally spaced positions, and wherein the trencher frame carries first and second sets of laterally spaced mounting holes for the safety guide with the first and second sets of safety guide mounting holes overlying the first and second sets of chain bar mounting holes to allow the safety guide to be installed on the trencher frame in an overlying relationship relative to the chain bar regardless of which laterally spaced position the chain bar has been installed in.

* * * * *